United States Patent [19]

Aiello et al.

[11] 4,430,204

[45] Feb. 7, 1984

[54] REMOVAL OF SURFACTANTS FROM HYDROCARBONS WITH ALCOHOL

[75] Inventors: Robert P. Aiello, Cypress; George Stefanidakis; Dwayne E. Poling, both of Houston, all of Tex.

[73] Assignee: Shell Oil Company, Houston, Tex.

[21] Appl. No.: 391,630

[22] Filed: Jun. 24, 1982

[51] Int. Cl.[3] ..... C10G 29/22

[52] U.S. Cl. ..... 208/240; 208/291; 585/864

[58] Field of Search ..... 208/240, 291, 232; 585/864

[56] References Cited

U.S. PATENT DOCUMENTS

| | | | |
|---|---|---|---|
| 2,357,344 | 9/1944 | Morris et al. | 208/240 |
| 2,846,359 | 8/1958 | Myers | 208/291 |
| 2,927,076 | 3/1960 | Jolly | 208/291 |
| 3,154,576 | 10/1964 | Fainman | 208/240 |

*Primary Examiner*—Delbert E. Gantz
*Assistant Examiner*—Anthony McFarlane
*Attorney, Agent, or Firm*—John M. Duncan

[57] ABSTRACT

A method is disclosed for removing hydrocarbon-soluble anionic surfactants from gasoline or kerosene boiling range hydrocarbons. The method comprises (a) contacting a hydrocarbon mixture containing surfactants with a lower alcohol which is miscible with the hydrocarbon mixture to extract the surfactants; (b) contacting the mixture with water or caustic solution to extract the lower alcohol and surfactants from the hydrocarbon mixture; (c) separating the water or caustic solution from the hydrocarbons; and (d) removing the hydrocarbons.

6 Claims, No Drawings

REMOVAL OF SURFACTANTS FROM HYDROCARBONS WITH ALCOHOL

BACKGROUND OF THE INVENTION

This invention is in the field of removing surfactants (predominantly sulfonates) from hydrocarbons particularly those in the gasoline or kerosene boiling range by mixing the hydrocarbons with alcohol followed by water washing.

It has been found that surfactants in gasoline can cause automobile fuel filter plugging, which can be very disconcerting to customers whose cars stall at inconvenient times. It is, of course, preferable that the various gasoline blending components not contain such surfactants. However, certain of these components, particularly alkylate, have a tendency to become contaminated with surfactants, such as sulfonates, during refinery processing. Where such contamination has occured, it is highly desirable to remove the contaminants as efficiently as possible.

A method of removing metal alkaryl sulfonates from crude oil is disclosed in U.S. Pat. No. 4,274,943. The crude oil containing the metal alkaryl sulfonates is treated by (a) contacting it with an aqueous basic solution containing a "recovery surfactant", (b) forming a hydrocarbon phase and an aqueous phase containing the metal alkaryl sulfonates and (c) separating the hydrocarbon phase and the aqueous phase. "Recovery surfactants" include ethoxylated alcohols, ethoxylated alkylphenols, ethoxylated alcohol sulfates, polyoxyethylene-polyoxypropylene block polymers, and ethoxylated polypropylene glycols. The alkyl group in these "recovery surfactants" contains from 10–20 carbon atoms. While this process may be effective for removing metal alkaryl sulfonates from crude oil it is not considered suitable for removing surfactants from gasoline boiling range components.

Alkylate cleanliness has long been recognized as a problem in gasoline blending. Because the reactions involved in the manufacture of alkylate are conducted in the presence of sulfuric acid, all manner of sulfur and oxygen containing compounds may potentially be formed and become part of the alkylate stream. Caustic and water wash systems have been installed in alkylation units to reduce the level of contaminants in alkylate. These systems must be periodically checked, however, to insure their proper operation. Surfactants, if allowed to accumulate in storage systems, will migrate to the aqueous phase in storage tanks. When the tank contents are stirred up as they are, for example, during filling, these surfactants will tend to keep particulate matter and gelatinous material suspended in the product and thus increase the potential for carrying these materials either into the pipeline or at the extreme into automobile fuel tanks. It is important, therefore, that alkylate be treated as severely as necessary to reduce these surfactant levels in the finished product.

Accordingly, it is an object of this invention to provide a method for removing hydrocarbon-soluble anionic surfactants from gasoline or kerosene boiling range hydrocarbons.

SUMMARY OF THE INVENTION

A method is disclosed for removing hydrocarbon-soluble anionic surfactants from gasoline or kerosene boiling range hydrocarbons which comprises:

(a) contacting a hydrocarbon-surfactant mixture with an effective amount of a lower alcohol, which is miscible with said hydrocarbons, for a time sufficient to extract a desired quantity of said surfactants from the hydrocarbon-surfactant mixture;

(b) contacting the mixture with an effective amount of water or caustic solution for a time sufficient to extract a major portion of said lower alcohol and surfactants from said hydrocarbons;

(c) separating the water or caustic solution containing said alcohol and surfactants from said hydrocarbons; and (d) recovering said hydrocarbons.

DETAILED DESCRIPTION OF THE INVENTION

Because of the filter-plugging problems associated with surface-active agents in gasoline or jet fuel, it is important to be able to determine when such surfactants are present before the problems arise. A simple sensitive (colorimetric) test has been developed for the most frequently encountered gasoline surfactants, e.g. sulfonic acids and sulfonates, in alkylate, gasoline, aviation turbine fuel, diesel fuel, etc., over the range 0–60 ppm. The method is summarized briefly as follows.

Fifteen ml of alkylate are shaken with three ml of 0.1 N sodium hydroxide dissolved in a 1:1 mixture of methanol and water. Two ml of lower caustic layer is then shaken with four ml of a methylene blue solution plus two ml of chloroform and allowed to separate. One ml of the lower chloroform layer is then diluted with six ml of a 9:1 mixture of isooctane: isopropyl alcohol and the transmittance measured with a colorimeter.

The standardization procedure for the Colorimetric Sulfonate Test is accomplished using a standard solution of Petronate HL (Witco Chemical Company) sodium petroleum sulfonates in isooctane. The standard is diluted volumetrically to prepare a series of standard solutions with several different levels of sulfonates, for example, 5, 10, 20, 40 ppm. The sulfonate test is then run on the series of standards. A calibration curve is prepared by plotting % transmittance versus sulfonate concentration in ppm on a semi-log paper. A straight line is obtained.

A similar method has been developed for the detection of naphthenic acids and sodium naphthenates which are occasionally found in aviation turbine fuel. These surfactants are also extractable from aviation turbine fuel with 0.1 N NaOH in 1:1 methanol/water solution. However, in the naphthenate test, the caustic extract is shaken with a $CuSO_4$ solution which converts the water-soluble sodium naphthenates to hydrocarbon-soluble copper naphthenates. These are then extracted into isooctane. Copper naphthenates impart a greenish-blue color to the isooctane layer which becomes detectable when the naphthenic acid concentration in turbine fuel exceeds 50 ppm. The detection of naphthenic acid and naphthenates in concentrations as low as 10 ppm can be achieved by the addition of one drop of 0.1 M Butyl Zimate (zinc dibutyldithiocarbamate) solution to the isooctane layer. Copper dibutyldithiocarbamate, which has an intense yellow color, is formed upon reaction of copper naphthenates with the zinc salt.

The preceding methods for detection of sulfonates and naphthenates, although very sensitive, are specific for these surfactants. A more comprehensive test is desirable which will measure the total contribution of all surfactants which may occur in hydrocarbons. Since surfactants exert a profound influence on interfacial tension at a water/hydrocarbon interface, a simplified modification of the constant volume drop time (CVDT) method for determination of interfacial tension has been devised for surfactant detection.

In the CVDT method, drops of 1 N NaOH varying in size are dispensed from the tip of a capillary immersed in the hydrocarbon phase and the interfacial tension (IFT) is calculated from the volume of the drop, the densities of the two phases, the radius of the capillary, an empirical correction factor, and known physical constants. In the simplified modification which has been developed for detection of total surfactants, the only measurement needed is a time measurement—the time required for a drop of 1 N NaOH of constant volume to fall from a capillary tip immersed in the hydrocarbon sample.

A minimum amount of equipment is required for the modified test—a rigid stand for mounting a 500 microliter syringe, a capillary with a Luer adapter for attachment to the syringe, a device for delivery of drops of constant volume, an adjustable lab jack, and a stopwatch. The syringe (with a Teflon-coated stainless steel plunger) is filled with 1 N NaOH and drops of predetermined constant volume (30–80 microliters) are delivered to the capillary tip. The Hamilton Aliquanter, which is commercially available, is capable of accurately dispensing a series of predetermined microliter quantities of the liquid from the syringe.

The surfactant level in hydrocarbons has a pronounced effect on the time required for a drop of 1 N NaOH to become detached from the tip of the capillary. Drop detachment time is inversely proportional to surfactant concentration and may vary from intervals greater than 600 seconds for clean fuel to 5 seconds or less when as little as 5–10 ppm of various surfactants are incorporated in the same fuel. A linear log/log plot is obtained when drop detachment time in seconds is plotted against surfactant concentration in parts per million (ppm).

Another test used to determine the effectiveness of various methods of removing surfactants from hydrocarbons is called the Water Reactivity Test (WRT). This test involves shaking 80 ml of hydrocarbon and 20 ml of pH 7 buffer (obtained from Fisher) in a 100 ml mixing cylinder (either mechanically or by hand) for two minutes. After standing for five minutes, the appearance of the gasoline, interface and water is rated. The rating scale is as follows.

| Rating Scale | | |
|---|---|---|
| Gasoline Phase | CL | clear |
| | SH | slight haze |
| | HH | heavy haze |
| Interface | 0 | clean, no bubbles |
| | 1 | bubbles only |
| | 2 | bubbles and/or slight film |
| | 3 | film |
| | 4 | shred or scum, light lace in less than ½ water volume |
| | 5 | shred or scum, light lace in more than ½ water volume |
| | 6 | emulsion, record approximate volume in ml |
| Water Phase | CL | clear |
| | WC | water cloudiness |

This test may be too severe for some hydrocarbons such as alkylate and will not adequately distinguish among samples containing small differences in surfactant levels. In these cases, the test may be modified by increasing the standing time and rating the sample not only after the normal five minutes but also after additional periods up to 24 hours. Using the extended procedure, samples can be ranked more easily. A measure known as the Water Reactivity Index (WRI), which is the sum of the interface cuff values for the chosen inspection periods, is an easy way to rank order hydrocarbon samples. An increase in water reactivity or surfactants will cause an increase in WRI.

While studying various ways to remove surfactants from refinery alkylate streams we discovered that the addition of methanol to alkylate prior to water washing resulted in a marked improvement in the treated alkylate Water Reactivity Test.

Even better results were obtained using a methanol/caustic wash followed by a water wash (water reactivity test recording Cl, 2, CL after just 20 minutes). This was tried because if methanol were injected into alkylate, it would be extracted into the next aqueous phase in the processing scheme. Thus, with methanol injection at a convenient point downstream of the alkylation reactor/settler, methanol would be extracted into the caustic wash ultimately resulting in a caustic/methanol wash when equilibrium was reached. The water reactivity results were compared with sulfonate concentration. In general, sulfonate concentration decreased as water reactivity improved, as expected.

Some further comparisons of alkylate samples with and without methanol were made using the CVDT method. These tests showed the importance of residence time when extracting surfactant from alkylate using caustic. The CVDT, when rerun on the same sample, increases dramatically during a three-day test period. The CVDT can be considered as a monitored caustic washing procedure. As such, it will remove a considerable amount of surfactant from the alkylate sample if given enough time, even with no agitation and the small amounts of caustic used in the test. When methanol was used in the alkylate, the extraction took place faster as evidenced by the much lower CVDT values early in the test period. It is obvious that surfactants can be removed from alkylate or gasoline with water if residence times are long enough. Methanol used appropriately during the alkylate cleanup phase of processing should reduce the time required for surfactant removal, in effect making the washing processes more efficient.

The alcohol used to extract surfactants from hydrocarbons should be one which is both miscible with the hydrocarbons and an excellent solvent for the highly polar surfactant materials (predominantly sulfonates). Suitable lower alcohols ($C_1$–$C_5$ range) are methanol, ethanol, propanol, isopropanol, butanol, isobutanol and pentanol. Particularly suitable for gasoline boiling range hydrocarbons, such as alkylate, is methanol.

The amount of alcohol used to contact a hydrocarbon-surfactant mixture will vary, depending on the alcohol used, the boiling range of the hydrocarbon stream to be treated and the amount of surfactant present therein. An effective amount can be readily determined by making a few laboratory tests with the hydrocarbon to be treated and the alcohol selected. Generally, it will be sufficient to add from about 0.1 to about 5%v alcohol and agitate or mix the hydrocarbon-alcohol solution with a mechanical mixer. Addition of about 1%v alcohol is usually considered to be an appropriate amount.

The mixing should be sufficiently vigorous and extend over a long-enough period to permit the surfactants in the hydrocarbons to associate intimately with the alcohol.

The hydrocarbon-surfactant-alcohol stream is then contacted with an effective amount of either water or dilute caustic solution for a time sufficient to extract most of the lower alcohol and surfactants from the hydrocarbons. The quantity of water or caustic solution and the length of contact will vary according to the hydrocarbon being treated, the type of alcohol and the quantity of surfactant. However, these values can be readily determined by a few laboratory experiments. Generally, the water or caustic solution contact with the hydrocarbons may be expedited by agitation or mixing with a mechanical mixer for from about 1 to about 5 minutes. About a 50/50 mixture of water or caustic with hydrocarbon is sufficient to remove the alcohol and surfactants from the hydrocarbons.

When caustic solution is used, generally a dilute solution of about 0.1 N NaOH will be suitable.

After the water or caustic solution wash, the hydrocarbons are separated from the aqueous phase and the treated hydrocarbons, now essentially free of surfactants, are recovered. The separation and recovery are accomplished in any of several ways which are well known in the art.

The invention will now be illustrated with reference to the following examples, which are intended to be a complete specific embodiment of the invention and are not intended to be regarded as a limitation thereof.

EXAMPLE 1

A sample of production alkylate was percolated through a silica gel column to remove any surfactants (Alkylate 1). Methanol was used as a polar solvent for elution of the most polar surfactants from the silica gel column. Five additional samples were prepared by adding the methanol-surfactant eluate from the silica gel column to alkylate 1 in various concentrations up to 20 ppmv (Alkylates 2–6). These six alkylate samples were then evaluated by the Constant Volume Drop Time (CVDT) test.

The CVDT test consists of forming a 1.0 N sodium hydroxide drop of controlled volume on the tip of a stainless steel capillary below the surface of the test liquid. The time required for the drop to fall is measured as the CVDT. Drop time decreases as surfactant level increases. The addition of the methanol/surfactant solution to clean alkylate caused a rapid drop in CVDT as was expected (see Table 1). A blank containing only methanol was included in the evaluation since the alcohol itself can affect CVDT. This effect is thought to be caused by the extraction of methanol from the alkylate into the caustic drop which increases the dropsize slightly thereby reducing drop time. As can be seen in Table 1, the effect of methanol alone is slight compared to that of the surfactant.

TABLE 1

| Percolated Alkylate Sample (a) | Additive Concentration ppmv | MeOH + Surfactant Residue, CVDT, (b) Seconds | MeOH blank, CVDT, (b) Seconds |
|---|---|---|---|
| 1 | 0 | 230 | 230 |
| 2 | 1 | 165 | — |
| 3 | 2.5 | 100 | — |
| 4 | 5.0 | 75 | 185 |
| 5 | 10 | 50 | 175 |
| 6 | 20 | 25 | 155 |

(a) Percolated over Silica Gel to remove surfactants.
(b) Constant Volume Drop Time with 30 ml Drop.

EXAMPLE 2

To demonstrate the potential of a lower alcohol for removing surfactants from a refinery hydrocarbon stream, a commercial alkylate sample was subjected to various treatments, as shown in Table 2. These samples were then tested for Water Reactivity Test, as described in Table 2.

TABLE 2

Removal of Surfactant from Commercial Alkylate using Methanol

| Alkylate Sample | Treatment | Water Reactivity (a) Initial | 20 Minutes | 24 Hours |
|---|---|---|---|---|
| 7 | None | CL,5,WC (17) | CL,5,WC (16) | CL,4,CL (1.5) |
| 8 | Percolated over Silica Gel | CL,0,CL | — | — |
| 9 | + 1% MeOH | SH,5,WC (17) | SH,5,WC (15) | CL,4,CL (1) |
| 10 | Water Wash (b) | CL,5,WC (15) | CL,5,WC (12) | CL,4,CL (1) |
| 11 | + 1% MeOH + Water Wash (b) | CL,4,CL (9) | CL,4,CL (1) | CL,2,CL |
| 12 | MeOH/Caustic Wash (c) | CL,5,WC (14) | CL,4,CL (10) | CL,4,CL (0.5) |
| 13 | Followed by Water Wash (b) | CL,4,CL (3) | CL,2,CL | CL,2,CL |

(a) Water Reactivity Test - 80 ml of alkylate shaken with 20 ml. pH 7 buffered water for two minutes. Alkylate/interface/water rated after five minutes standing. CL = clear, SH = slight haze, WC = water cloudy. Interface rates from 0–3 = acceptable; 4 = lace < ½ water volume; 5 = lace > ½ water volume; and 6 = emulsion. Values in parentheses are the volumes of interfacial lace or cuff.
(b) 50/50 alkylate vol/water vol, mechanical shaker.
(c) 75/25 alkylate vol/wash vol, MeOH/caustic 0.5N 50/50 vol/vol, mechanical shaker.

The commercial alkylate with no treatment (7) reacted poorly in the Water Reactivity test, thereby indicating the presence of an excess of surfactants. When this alkylate was percolated over silica gel (8) excellent water reactivity results were obtained, thereby indicating that the surfactants contained in the alkylate had been removed.

The addition of 1% methanol (MeOH) (9) or a 50/50 alkylate/water wash treatment, including a mechanical shaker, (10) did not improve the Water Reactivity results.

When 1% MeOH was added to the commercial alkylate (11) before the water wash treatment a significant improvement in Water Reactivity was obtained.

Even better results were obtained using a methanol/caustic wash (12) and a further improvement was obtained by following the methanol/caustic wash with a water wash (13).

EXAMPLE 3

Some further comparisons of commercial alkylate samples with and without methanol were made using the CVDT test. These data are presented in Tables 3 and 4. The data show the importance of residence time when extracting surfactant from alkylate using caustic. The CVDT, when rerun on the same sample, increases dramatically during a three-day test period. The CVDT can be considered as a monitored caustic washing procedure. As such, it will remove a considerable amount of surfactant from the alkylate sample if given enough time, even with no agitation and the small amounts of caustic used in the test. When methanol was used in the alkylate, the extraction took place faster as evidenced by the much lower CVDT values early in the test period. It is obvious that surfactants can be removed from alkylate or gasoline with water if residence times are long enough as shown by the interfacial surfactant emulsion found in every bulk storage tank. Methanol used appropriately during the alkylate cleanup phase of processing should reduce the time required for surfactant removal, in effect making the washing processes more efficient.

TABLE 3

| Alkylate Sample | CVDT, (a) Seconds 30 μl Drop | 50 μl Drop |
|---|---|---|
| 14 | 176 | 23 |
| 15 (b) | 245 | 27 |
| 16 (c) | 364 | 33 |
| 17 (d) | 584 | 29 |

(a) Constant Volume Drop Time Test.
(b) Rerun on the same sample approximately one hour later. The caustic solution continues to extract surfactant from the alkylate and the CVD increases with time.
(c) Rerun on the same sample approximately four hours later.
(d) Rerun on the same sample three days later.

TABLE 4

| Alkylate Sample | CVDT, (a) Seconds 30 μl Drop | 40 μl Drop |
|---|---|---|
| 18 | 50 | 37 |
| 19 (b) | 203 | 104 |
| 20 (c) | 395 | 182 |
| 21 (d) | 631 | 281 |

(a) Constant Volume Drop Time Test.
(b) Rerun on the same sample approximately one hour later.
(c) Rerun on the same sample approximately four hours later.
(d) Rerun on the same sample three days later.

EXAMPLE 4

The degree of agitation or mixing of the two phases in the washing procedure is very important. Table 5 contains data comparing a less severe mechanical shaking procedure with a vigorous hand shaking procedure during the washing operations. The data show that methanol treatment, as before, improved wash efficiency when the less severe mechanical shaking was used. However, when a much more vigorous agitation procedure was used, surfactant removal efficiency of the washing procedure improved and treatments with and without methanol had equivalent results. Thus, the increase of agitation or mixing in current washing operations should be considered as well as the use of methanol to improve washing efficiency.

TABLE 5

Removal of Surfactant from Commercial Alkylate using Various Washing Techniques

| Alkylate Sample | Treatment | Water Reactivity (a) Initial | 20 Minutes | 1 Hour |
|---|---|---|---|---|
| 22 | None | CL,5,WC (17) | CL,5,WC (16) | CL,5,WC (12) |
| 23 | Caustic Wash and Water Wash (c) | CL,4,CL (6) | CL,4,CL (0.5) | CL,4,CL (0.5) |
| 24 | MeOH/Caustic Wash and Water Wash (c) | CL,4,CL (5) | CL,2,CL | CL,2,CL |
| 25 | Caustic Wash and Water Wash (d) | CL,3,CL | CL,2,CL | CL,2,CL |
| 26 | MeOH/Caustic Wash and Water Wash (d) | CL,3,CL | CL,2,CL | CL,2,CL |

(a) Water Reactivity Test - 80 ml. of gasoline shaken with 20 ml. pH 7 buffered water for two minutes. Gasoline/interface/water rated after five minutes standing. CL = clear, SH = slight haze, WC = water cloudy. Interface rates from 0-3 = acceptable, 4 = lace < ½ water volume, 5 = lace > ½ water volume and 6 = emulsion. Values in parentheses are the volume of interfacial lace or cuff.
(b) Caustic used was 0.5 N NAOH or 50/50 vol/vol MeOH/0.5 N NAOH. A ratio of 75/25 vol/vol Alky/Caustic wash was used. Deionized water was used for the water washes. 50/50 vol/vol alky/water.
(c) Mechanical shaker used.
(d) Shaken vigorously by hand.

What is claimed is:

1. A method for removing hydrocarbon-soluble anionic surfactants from gasoline or kerosene boiling range hydrocarbons which comprises:
   (a) treating a hydrocarbon-surfactant mixture with an effective amount of methanol or ethanol for a time sufficient to permit a desired proportion of said surfactants in the hydrocarbon-surfactant mixture to associate intimately with the alcohol;
   (b) contacting the hydrocarbon-surfactant-alcohol mixture with an effective amount of either water or caustic solution, or caustic solution followed by water, for a time sufficient to extract a major portion of said methanol or ethanol and surfactants from said hydrocarbons;
   (c) separating the water or caustic solution containing said methanol or ethanol and surfactants from said hydrocarbons; and
   (d) recovering said hydrocarbons.

2. The method of claim 1 wherein the anionic surfactants are predominantly sulfonates in gasoline and the gasoline boiling range hydrocarbons have been prepared in an alkylation process.

3. The method of claim 2 wherein the lower alcohol is methanol.

4. The method of claim 1 wherein the hydrocarbon-surfactant mixture is contacted with methanol, followed by contacting with a dilute caustic solution, and then by contacting with water.

5. A method for removing polar surfactants from a gasoline boiling range alkylate which comprises:
   (a) contacting the alkylate with an effective amount of methanol for a time sufficient to extract a desired quantity of said surfactants from said alkylate;
   (b) contacting the alkylate-methanol mixture with an effective amount of water to remove a desired amount of methanol and surfactants from said alkylate;
   (c) separating the water containing alcohol and surfactants from the alkylate; and
   (d) recovering the alkylate.

6. The method of claim 5, wherein the polar surfactants comprise sulfonates.

* * * * *